US011371723B2

(12) United States Patent
Cao et al.

(10) Patent No.: US 11,371,723 B2
(45) Date of Patent: Jun. 28, 2022

(54) AIR-CONDITIONER OUTDOOR UNIT AND CONTROL METHOD FOR FAN OF AIR-CONDITIONER OUTDOOR UNIT

(71) Applicants: GREE ELECTRIC APPLIANCES (WUHAN) CO., LTD, Wuhan (CN); GREE ELECTRIC APPLIANCES, INC. OF ZHUHAI, Zhuhai (CN)

(72) Inventors: Peng Cao, Zhuhai (CN); Limin Li, Zhuhai (CN); Tao Feng, Zhuhai (CN); Wenhao Huang, Zhuhai (CN); Mengmeng Jin, Zhuhai (CN); Chu Wang, Zhuhai (CN); Shiqiang Zhu, Zhuhai (CN); Chao Zhou, Zhuhai (CN)

(73) Assignees: GREE ELECTRIC APPLIANCES (WUHAN) CO., LTD, Wuhan (CN); GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 189 days.

(21) Appl. No.: 16/603,465

(22) PCT Filed: Dec. 22, 2017

(86) PCT No.: PCT/CN2017/118102
§ 371 (c)(1),
(2) Date: Oct. 7, 2019

(87) PCT Pub. No.: WO2018/227922
PCT Pub. Date: Dec. 20, 2018

(65) Prior Publication Data

US 2021/0131679 A1 May 6, 2021

(30) Foreign Application Priority Data

Jun. 14, 2017 (CN) ..... 201710448171.4

(51) Int. Cl.
*F24F 1/38* (2011.01)
*F24F 11/77* (2018.01)
(Continued)

(52) U.S. Cl.
CPC ..... *F24F 1/38* (2013.01); *F24F 1/46* (2013.01); *F24F 11/77* (2018.01); *F24F 2110/30* (2018.01)

(58) Field of Classification Search
CPC ..... F24F 1/38; F24F 1/46; F24F 11/77; F24F 2110/30; F24F 2110/32
See application file for complete search history.

(56) References Cited

U.S. PATENT DOCUMENTS

| | | | |
|---|---|---|---|
| 9,385,642 | B2 | 7/2016 | Hatakeyama et al. |
| 2015/0028780 | A1 | 1/2015 | Hatakeyama et al. |
| 2016/0282005 | A1 | 9/2016 | Kim et al. |

FOREIGN PATENT DOCUMENTS

| | | | |
|---|---|---|---|
| CN | 1766448 | A | 5/2006 |
| CN | 1913332 | A | 2/2007 |

(Continued)

OTHER PUBLICATIONS

CN106642572A translation (Year: 2017).*

(Continued)

*Primary Examiner* — Schyler S Sanks
(74) *Attorney, Agent, or Firm* — Oblon, McClelland, Maier & Neustadt, L.L.P.

(57) ABSTRACT

An air-conditioner outdoor unit and a control method for a fan (100) of an air-conditioner outdoor unit; the air-conditioner outdoor unit of the present invention comprises a fan (100) and a deflector ring (200) that is sleeved on the outside of a vane (110) of the fan (100); further comprised are a vane stopping device (300), a wind speed measuring device (400), and a control system. The vane stopping device (300) is (Continued)

disposed on the deflector ring (200), is connected to the control system, and may cause a vane (110) that is passively rotating to stop rotating; the wind speed measuring device (400) is connected to the control system, and is used for detecting the wind speed flowing through the vane (110), the wind speed comprising a wind speed value and a wind speed direction; the control system controls the vane stopping device (300) to start and shut down according to the wind speed that is detected by the wind speed measuring device (400), and controls actual start-up frequency of the fan (100) according to the wind speed that is detected by the wind speed measuring device (400). The air-conditioner outdoor unit and the control method for the fan (100) of the air-conditioner outdoor unit may compensate the rotational speed of the fan (100), and ensure the start-up success rate of the fan (100).

3 Claims, 6 Drawing Sheets

(51) Int. Cl.
*F24F 1/46* (2011.01)
*F24F 110/30* (2018.01)

(56) References Cited

FOREIGN PATENT DOCUMENTS

| | | | | |
|---|---|---|---|---|
| CN | 101514687 | A | | 8/2009 |
| CN | 101839212 | A | | 9/2010 |
| CN | 105737275 | A | | 7/2016 |
| CN | 105757825 | A | | 7/2016 |
| CN | 106642572 | A | * | 5/2017 |
| CN | 106642572 | A | | 5/2017 |
| CN | 107101285 | A | | 8/2017 |
| EP | 3 093 584 | A1 | | 11/2016 |
| JP | 2002-235934 | A | | 8/2002 |
| JP | 2002235934 | A | * | 8/2002 |
| JP | 2004-347209 | A | | 12/2004 |
| JP | 2005-249346 | A | | 9/2005 |
| JP | 2011-109735 | A | | 6/2011 |
| JP | 2014-18070 | A | | 1/2014 |
| WO | WO 2013/132620 | A1 | | 9/2013 |

OTHER PUBLICATIONS

JP2002235934A translation (Year: 2002).*
International Search Report dated Feb. 26, 2018 in PCT/CN2017/118102, 13 pages (with English translation).
Combined Office Action and Search Report dated May 24, 2018 in Chinese Patent Application No. 201710448171.4, 9 pages (with English translation of categories of cited documents).

* cited by examiner

AIR-CONDITIONER OUTDOOR UNIT AND CONTROL METHOD FOR FAN OF AIR-CONDITIONER OUTDOOR UNIT

RELATED APPLICATION

The present application claims the priority of Chinese Patent Application No. 201710448171.4, filed on Jun. 14, 2017 and entitled "AIR-CONDITIONER OUTDOOR UNIT AND CONTROL METHOD FOR FAN OF AIR-CONDITIONER OUTDOOR UNIT", whose entire contents are incorporated herein as reference.

TECHNICAL FIELD

The present invention relates to the field of air conditioner technology, in particular to an air-conditioner outdoor unit and a control method for a fan of the air-conditioner outdoor unit.

BACKGROUND ART

An upper air-outlet multi-split outdoor unit is generally installed on the roof of a high-rise building. If the installation area of the unit happens to be in a monsoon climate area, in the case that the multi-split unit is in a shutdown state and the wind speed in the air exceeds a certain speed, the still outdoor fan in the shutdown state will be driven to rotate. At this time, if a start-up command is sent to the unit, the unit will change from the shutdown state to the start-up state. When the fan starts, the airflow will hinder the fan from rapidly operating to a specified frequency. If the unit detects inconsistency of the actual operating frequency of the fan and the specified frequency within a specified time, the machine will report "fan out-of-step protection", which will cause the failure of the start-up of the fan. While in the start-up process, the machine will stop working if three times of "out-of-step protection" are continuously detected, so that the purpose of regulating indoor air cannot be achieved.

CONTENTS OF THE INVENTION

On such a basis, the technical problem to be solved by the present invention is to provide an air-conditioner outdoor unit and a control method for a fan of the air-conditioner outdoor unit being configured to compensate a rotational speed of the fan to ensure the start-up success rate of the fan.

The air-conditioner outdoor unit comprises:

a fan;

a deflector ring sleeved on the outside of a vane of the fan;

a vane stopping device on the deflector ring, being configured to prevent the vane that is passively rotating from rotating;

a wind speed measuring device, for detecting the wind speed of wind flowing through the vane, wherein the wind speed comprises a wind speed value and a wind speed direction; and a control system connecting with the vane stopping device and the wind speed measuring device, for controlling the vane stopping device to start or shut down according to the wind speed that is detected by the wind speed measuring device, and controlling a start-up frequency of the fan according to the wind speed that is detected by the wind speed measuring device.

In one of the embodiments, the vane stopping device comprises an elastic sheet and a driving member, a groove is disposed on an inner side of the deflector ring, the elastic sheet is movably disposed in the groove, and the driving member is configured to drive the elastic sheet to abut against the vane to prevent the vane from passively rotating.

In one of the embodiments, the driving member comprises an electromagnetic conducting sheet fixedly disposed in the groove, and the elastic sheet and the electromagnetic conducting sheet are configured to generate a repulsive force when being supplied with currents in the same direction, so as to push the elastic sheet to abut against the vane to prevent the vane from passively rotating.

In one of the embodiments, the elastic sheet comprises pushing portions at two ends and a blocking portion in the middle; the pushing portions are movably disposed in the groove; two electromagnetic conducting sheets are respectively disposed at the two ends of the elastic sheet and opposite to the pushing portions; when the elastic sheet and the electromagnetic conducting sheets are supplied with currents in the same direction, the pushing portions at the two ends are pushed by the repulsive force to approach to each other, and the blocking portion is extruded to project toward the vane, and the projected blocking portion abuts against the vane and causes the vane to stop rotating.

In one of the embodiments, the projected height of the blocking portion ranges from 15 to 20 mm.

In one of the embodiments, two vane stopping devices are symmetrically disposed on the deflector ring.

The control method for a fan of an air conditioner outdoor unit comprises the following steps:

detecting a wind speed value;

controlling the fan to start when the wind speed value is less than a preset value; and controlling the fan to start with a compensated start-up frequency after preventing a vane from passively rotating by blocking the outer edge of the vane of the fan, when the wind speed value is greater than the preset value.

In one of the embodiments, the step of controlling the fan to start with a compensated start-up frequency comprises:

detecting a wind speed direction when the wind speed value is greater than the preset value; and determining the compensated start-up frequency of the fan according to the wind speed value, the wind speed direction and a target operating frequency of the fan.

In one of the embodiments, the step of determining the compensated actual start-up frequency of the fan according to the wind speed value, the wind speed direction and a target operating frequency of the fan comprises:

subtracting the frequency corresponding to the wind speed value from the target operating frequency of the fan according to the wind speed value, to obtain the compensated start-up frequency of the fan, when the fan rotates in a forward direction due to the wind speed direction; and adding the frequency corresponding to the wind speed value to the target operating frequency of the fan according to the wind speed value, to obtain the compensated start-up frequency of the fan, when the fan rotates in a reverse direction due to the wind speed direction.

In one of the embodiments, the step of preventing the vane from passively rotating by blocking the outer edge of the vane of the fan comprises blocking the outer edge of the vane by the vane stopping device to prevent the vane from passively rotating.

In one of the embodiments, the vane stopping device comprises an elastic sheet and a driving member, a groove is disposed in the inner side of the deflector ring of the fan, the elastic sheet is movably disposed in the groove, and the driving member is configured to drive the elastic sheet to abut against the vane to prevent the vane from passively rotating.

In the above-mentioned air-conditioner outdoor unit, the vane stopping device on the deflector ring can prevent the fan from rotating according to a shutdown command when the fan in shut-down state is driven to rotate by external airflow. The wind speed measuring device can detect the magnitude and direction of the wind flowing through the vane. According to the magnitude of the wind speed, the unit performs, a compensation operation on the actual operating frequency and a compensation size are set by the unit, which greatly improves the start-up success rate of the fan, thereby ensuring the normal operation of an air-conditioner.

In the above-mentioned control method for the fan, the fan is controlled by the vane stopping device and the wind speed measuring device according to the detected wind speed. When the wind speed value is greater than the preset value, the rotational speed of the fan is compensated, so as to improve the start-up success rate of the fan, and to ensure the normal operation of the air-conditioner.

BRIEF DESCRIPTIONS OF THE DRAWINGS

REFERENCE SIGNS

Figure 1:
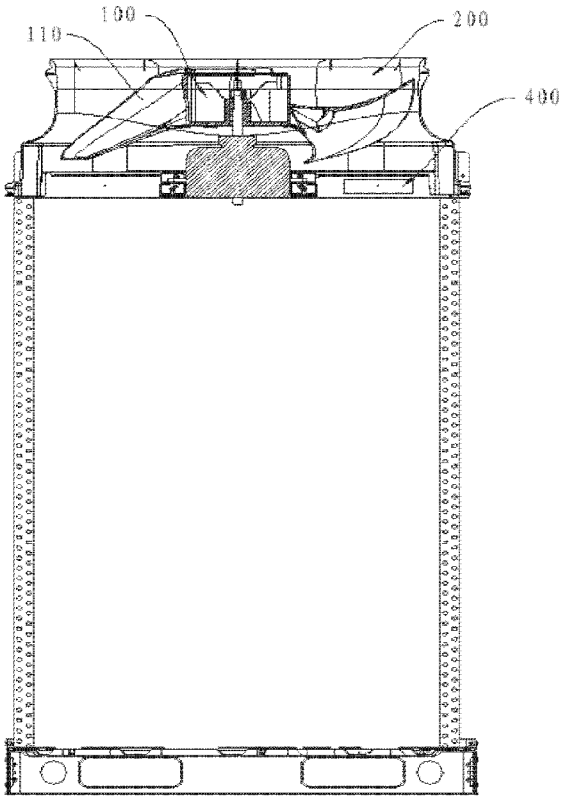
FIG. 1 is a schematic view showing the internal structure of an air-conditioner outdoor unit according to the present invention.

Fan 100;
Vane 110;
Deflector ring 200;
Vane stopping device 300;
Elastic sheet 310;
Electromagnetic conducting sheet 320;
Pushing portion 311;
Magnetic conducting portion 311*a;*
Guiding portion 311*b;*
Blocking portion 312;
Wind speed measuring device 400.

DETAILED DESCRIPTION OF THE EMBODIMENTS

The detailed description of the specific embodiments of the present invention is set forth in conjunction with the accompanying drawings, but the present invention may be implemented in various and different manners defined and covered by the claims.

Figure 2:
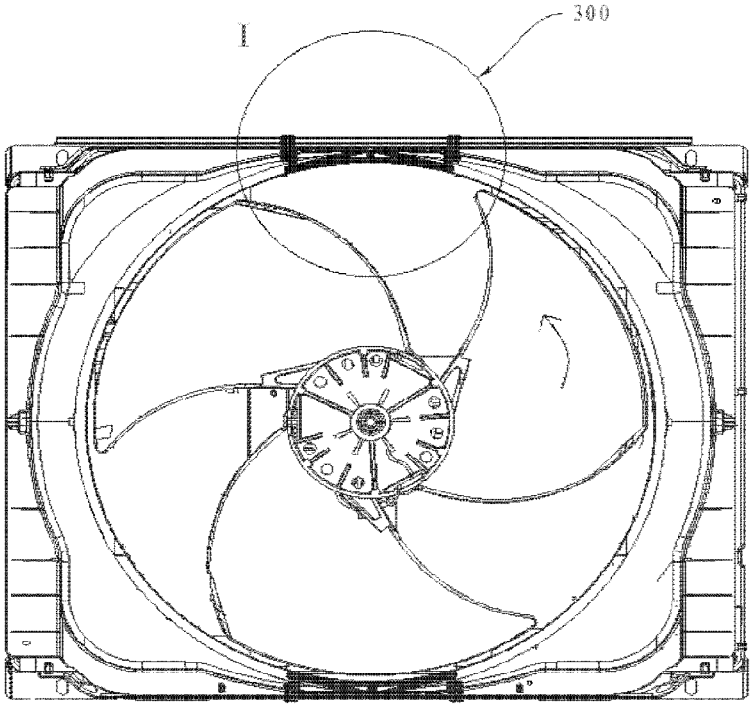
FIG. 2 is a first schematic top view of the air-conditioner outdoor unit according to the present invention, showing a state that the vane is rotating in a forward direction and the vane stopping device is shut down.
Figure 3:
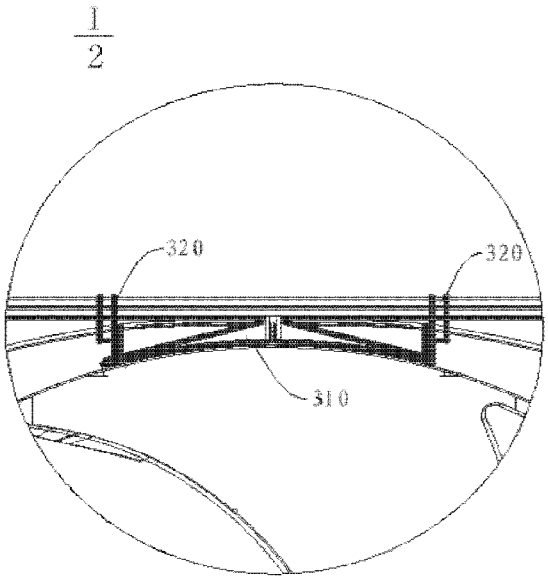
FIG. 3 is an enlarged view at I in FIG. 2.

Refer to FIG. 1 to FIG. 3, an air-conditioner outdoor unit in one embodiment of the present invention comprises a control system (not shown), a fan 100, a deflector ring 200 sleeved outside the vane 110 of the fan 100, a vane stopping device 300, and a wind speed measuring device 400. Both the vane stopping device 300 and the wind speed measuring device 400 are connected to the control system. The vane stopping device is disposed on the deflector ring 200, and the vane stopping device is configured to prevent the vane 110 that is rotating from passively rotating. The wind speed measuring device 400 is disposed inside the outdoor unit and is used for detecting a wind speed value and a wind speed direction inside the outdoor unit. The control system is configured to control the vane stopping device 300 to start or shut down as well as a start-up frequency of the fan according to the wind speed detected by the wind speed measuring device 400.

The air-conditioner outdoor unit above-mentioned is provided with the vane stopping device 300 on the deflector ring 200, and when the fan 100 in shut-down state is forced to rotate by the external airflow, a shutdown command can be executed to cause the fan 100 to stop rotating. The wind speed measuring device 400 can detect the magnitude and direction of the wind speed flowing through the vane 110, and according to the magnitude of the wind speed, a compensation operation on the actual operating frequency and the compensation size are set by the unit, thus greatly improving the start-up success rate of the fan 100, and ensuring the normal operation of an air-conditioner.

Further, the vane stopping device comprises an elastic sheet 310 and a driving member. A groove is disposed on an inner side of the deflector ring, and the elastic sheet 300 is movably disposed in the groove. The driving member is configured to drive the elastic sheet to abut against the vane to prevent the vane from passively rotating.

Still further, as shown in FIGS. 2 and 3, the driving member comprises an electromagnetic conducting sheet 320. The electromagnetic conducting sheet 320 is fixedly disposed in the groove. The elastic sheet 310 and the electromagnetic conducting sheet 320 are configured to generate a repulsive force when being supplied with currents in the same direction, so as to push the elastic sheet 310 to abut against the vane 110 to prevent the vane 110 from passively rotating. In other embodiments, the driving member may be configured as a mechanical drive structure, for example, a motor drives screws on two sides of the elastic sheet, and the screws push the elastic sheet 310, so that the projection in the middle of the elastic sheet 310 is generated to abut against the vane 110 for stopping. It is also possible that a screw driven by the motor directly pushes the middle of the elastic sheet to project to abut against the vane 110 for stopping.

Figure 4:
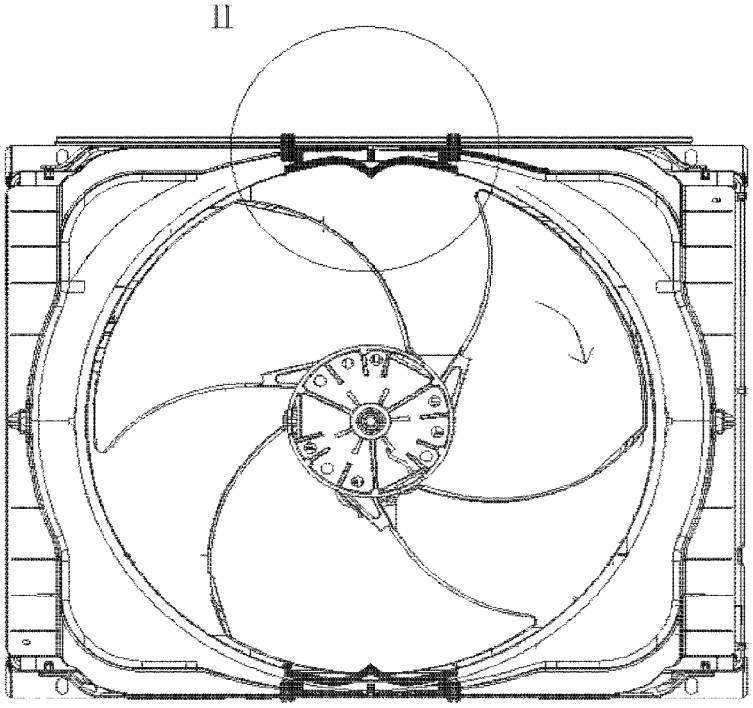
FIG. 4 is a second schematic top view of the air-conditioner outdoor unit according to the present invention, showing a state that the vane is rotating in a reverse direction and the vane stopping device is started up.
Figure 5:
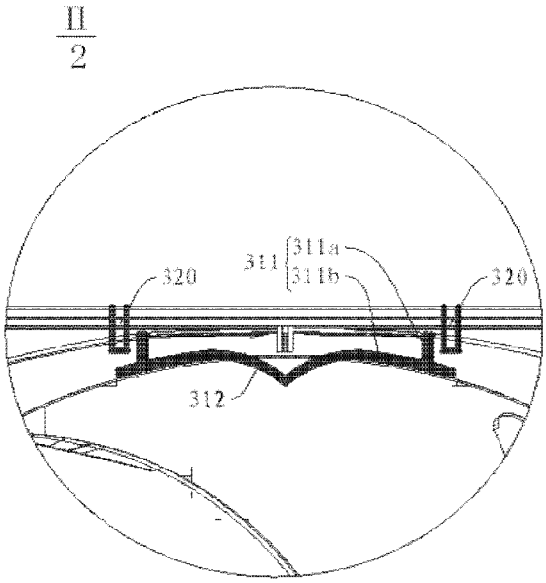
FIG. 5 is an enlarged view at II in FIG. 4.

As shown in FIGS. 4 and 5, specifically, the elastic sheet 310 comprises pushing portions 311 at two ends and a blocking portion 312 in the middle. The pushing portions 311 are movably disposed in the groove, and the pushing portions 311 are slidable along the groove. Two electromagnetic conducting sheets 320 are provided, and these two electromagnetic conducting sheets 320 are respectively disposed outside the pushing portions 311. Preferably, the pushing portion 311 comprises a magnetic conducting portion 311*a* and a guiding portion 311*b* connected with each other. The magnetic conducting portion 311*a* and the guiding portion 311*b* are disposed oppositely, and the guiding portion 311*b* is disposed in the groove. When being supplied with currents in the same direction, the magnetic conducting portion 311*a* and the electromagnetic conducting sheet 320 repel each other, so as to push the magnetic conducting portion 311*a* and the guiding portion 311*b* towards the middle.

The pushing portions 311 are pushed by the repulsive force to approach to each other, so that the blocking portion 312 in the middle of the elastic sheet 310 is extruded to project towards the vane 110, and the projected blocking portion 312 can abut against the vane 110 to block the blade of the vane 110 when the vane 110 is rotating, thus causing the vane 110 to stop rotating. When a restoration is required, the magnetic conducting portion 311*a* and the electromagnetic conducting sheet 320 are supplied with currents in opposite direction, and an active force between the magnetic conducting portion 311*a* and the electromagnetic conducting sheet 320 is generated to restore the elastic sheet. In other embodiments, the magnetic conducting portion 311*a* may also be a permanent magnet, and the electromagnetic conducting sheet 320 is configured to generate a repulsive force or an attractive force with the opposite magnetic conducting portion 311*a* when being supplied with power. When executing the command of starting the fan 100, the foregoing vane stopping device can ensure normal start-up of the fan 100 without any influence on the wind speed and the wind volume.

Specifically, the projected height of the blocking portion 312 may range from 15 to 20 mm. The blocking portion 312 may be configured as two hinged segments, and the connection part of the two segments projects when pushed at two ends. The blocking portion 312 may also be configured as an overall elastic sheet structure with elasticity.

Further, two vane stopping devices are symmetrically disposed on the deflector ring 200, so that the rotating vane 110 can be stopped more effectively and more quickly. The wind speed measuring device 400 is preferably disposed close to the vane, and is disposed at the side of the vane close to the motor. As the wind speed measuring device 400 is disposed close to the vane, the wind speed causing the vane 110 to rotate can be measured relatively accurately.

Figure 6:
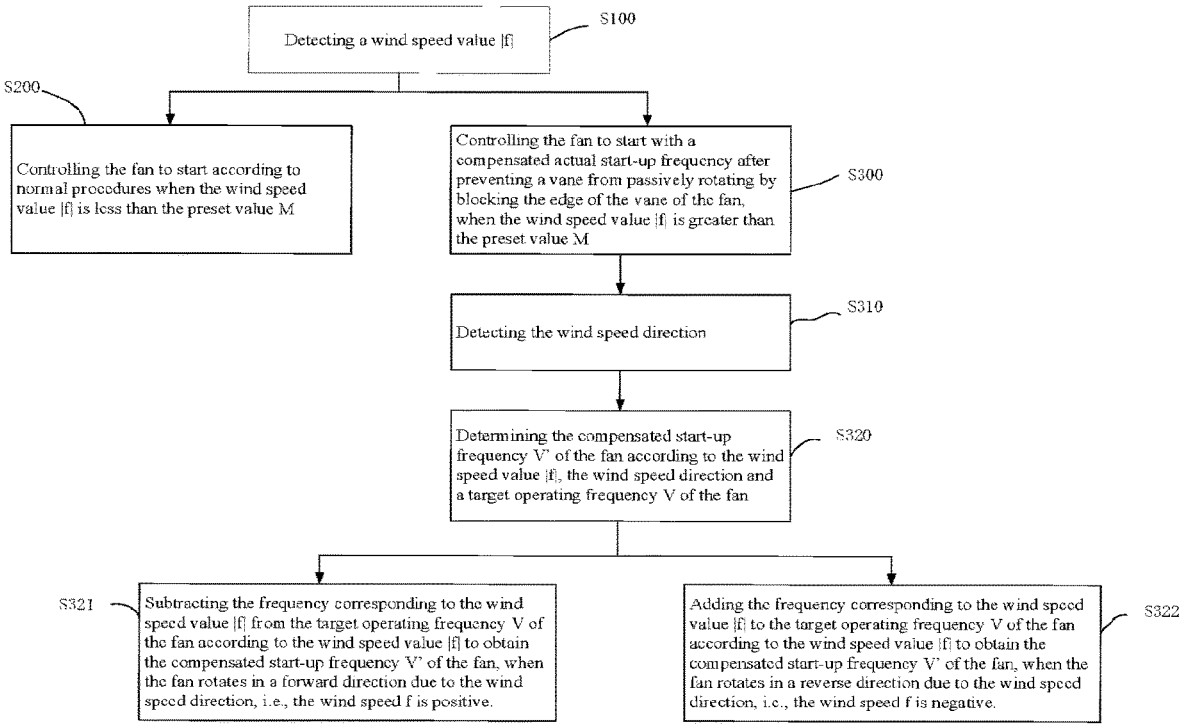
FIG. 6 is a flowchart of a control method for a fan of the air-conditioner outdoor unit according to the present invention.

As shown in FIG. 6, the control method for the fan of the air conditioner outdoor unit specifically comprises the following steps:

S100, detecting a wind speed value |f|;

S200, controlling the fan to start according to normal procedures when the wind speed value |f| is less than the preset value M;

S300, controlling the fan to start with a compensated start-up frequency after preventing a vane from passively rotating by blocking the outer edge of the vane of the fan, when the wind speed value |f| is greater than the preset value M.

The step of controlling the fan to start with a compensated start-up frequency comprises:

S310, detecting the wind speed direction, when the wind speed value |f| is greater than preset value M;

S320, determining the compensated start-up frequency V' of the fan according to the wind speed value |f| and the wind speed direction and a target operating frequency V of the fan.

The specific value of the preset value M is determined according to different vane structures. For vanes in different designs, different resistances are applied on vanes by the same wind speed, thereby values M being different.

After the unit is powered on, the wind speed measuring device keeps working, detects the wind speed f of the space where the outdoor unit is disposed, and transmits electronic signals converted from the wind speed to the master controller of the outdoor unit. When a space airflow is blown to the inside from a side return air inlet of the outdoor unit, that is, the wind blows from the inside of the vane to the outside, the fan and an anemometer rotate in a forward direction, and the wind speed f is positive. If the wind is blown in from an air outlet of the outdoor unit, that is, the wind blows from the outside of the vane to the inside, the fan and the anemometer rotate in a reverse direction, and the wind speed f is negative.

When the detected wind speed value |f|≤M, the fan can start normally without any action from the system, but when it is detected that the wind speed value |f|>M, the vane stopping device is started up to stop the fan from rotating, and after the fan stops, the outdoor unit performs the start-up action according to normal start-up commands, thereby preventing the failure of the start-up of the fan.

The foregoing control method for the fan controls the fan according to the detected wind speed through the vane stopping device and the wind speed measuring device. When the wind speed value is greater than the preset value, compensation for the rotational speed of the fan is implemented, so as to greatly improve the start-up success rate of the fan, thereby ensuring the normal operation of an air-conditioner.

Further, the step of determining the compensated start-up frequency of the fan according to the wind speed value and the wind speed direction and a target operating frequency of the fan comprises:

S321: subtracting the frequency corresponding to the wind speed value from the target operating frequency V of the fan according to the wind speed value |f| to obtain the compensated start-up frequency V' of the fan, when the fan rotates in a forward direction due to the wind speed direction, i.e., the wind speed f is positive;

S322: adding the frequency corresponding to the wind speed value |f| to the target operating frequency V of the fan according to the wind speed value |f| to obtain the compensated start-up frequency V' of the fan, when the fan rotates in a reverse direction due to the wind speed direction, i.e., the wind speed f is negative.

In the above steps, for a certain vane structure, the compensable frequency F can be converted from the wind speed value |f|, that is:

when the fan rotates in a forward direction due to the wind speed direction, i.e., the wind speed f is positive, the target operating frequency V of the fan is subjected to a negative correction, and the start-up frequency V' of the fan=the target operating frequency V of the fan−F;

when the fan rotates in a reverse direction due to the wind speed direction, i.e., the wind speed f is negative, the target operating frequency V of the fan is subjected to a positive correction, the start-up frequency V' of the fan=the target operating frequency V of the fan+F;

In this way, after the rotational speed correction, the fan operates with a frequency consistent with the target operating frequency of the fan, thus ensuring normal start-up of the complete air-conditioner.

Example of Fan Compensation:

When the machine starts, the target operating frequency V of the fan needs to be 50 Hz, then it can be ensured that the system pressure is quickly balanced after the compressor starts. If at this time, it is detected that the fan is rotating in a forward direction, then the start-up frequency V' can be set as 45 Hz, which ensures that the target operating frequency V of the fan reaches 50 Hz after adding the driving force of the wind speed on the vane (equivalent to 5 Hz); and if it is detected that the fan is rotating in a reverse direction, the start-up frequency V' then can be set as 55 Hz, which ensures that the target operating frequency V of the fan reaches 50 Hz after subtracting the resistance of the wind speed to the vane (equivalent to 5 Hz).

The above-mentioned embodiments are merely illustrative of several embodiments of the present invention, and the description thereof is relatively specific and detailed, but cannot be construed as limiting the patent scope of the present invention. It should be noted that a number of modifications and improvements may also be made by those of ordinary skill in the art on the premise of not departing from the spirit and scope of the invention, and these modifications and improvements are within the protection scope of the present invention. Therefore, the scope of the invention should be determined by the appended claims.

The invention claimed is:

1. A control method for a fan of an air conditioner outdoor unit, comprising:

detecting a wind speed value;

and starting the fan with a compensated start-up frequency after preventing a vane from passively rotating by blocking the outer edge of the vane of the fan in response to the wind speed value being greater than a preset value and in response to the wind speed value being less than or equal to the preset value starting the fan, wherein the preventing the vane from passively rotating by blocking the outer edge of the vane of the fan further comprises blocking the outer edge of the vane by a vane stopping device to prevent the vane from passively rotating, the vane stopping device including an elastic sheet and a driving member, a groove is disposed in the inner side of a deflector ring of the fan, the elastic sheet is movably disposed in the groove, and the driving member is configured to drive the elastic sheet to abut against the vane to prevent the vane from passively rotating.

2. The control method for the fan of the air conditioner outdoor unit according to claim 1, wherein the starting with the compensated start-up frequency further comprises:

detecting a wind speed direction when the wind speed value is greater than the preset value; and determining the compensated start-up frequency of the fan according to the wind speed value, the wind speed direction and a target operating frequency of the fan.

3. The control method for the fan of the air conditioner outdoor unit according to claim 2, wherein the determining the compensated start-up frequency of the fan according to the wind speed value, the wind speed direction and a target operating frequency of the fan further comprises:

according to the wind speed value, subtracting a frequency corresponding to the wind speed value from a target operating frequency of the fan, to obtain the compensated start-up frequency of the fan, in response to the fan rotating in a forward direction due to the wind speed direction; and according to the wind speed value, adding the frequency corresponding to the wind speed value to the target operating frequency of the fan, to obtain the compensated start-up frequency of the fan, in response to the fan rotating in a reverse direction due to the wind speed direction.

* * * * *